US011466521B2

(12) United States Patent
Campbell et al.

(10) Patent No.: US 11,466,521 B2
(45) Date of Patent: Oct. 11, 2022

(54) PLATFORM ASSEMBLY

(71) Applicant: Osbit Limited, Riding Mill (GB)

(72) Inventors: James Campbell, Riding Mill (GB); Martin Stuart Jolliffe, Riding Mill (GB); Stephen William Bedford, Riding Mill (GB)

(73) Assignee: Osbit Limited, Northumberland (GB)

( * ) Notice: Subject to any disclaimer, the term of this patent is extended or adjusted under 35 U.S.C. 154(b) by 0 days.

(21) Appl. No.: 17/433,880

(22) PCT Filed: Feb. 4, 2020

(86) PCT No.: PCT/EP2020/052703

§ 371 (c)(1),
(2) Date: Aug. 25, 2021

(87) PCT Pub. No.: WO2020/173670

PCT Pub. Date: Sep. 3, 2020

(65) Prior Publication Data

US 2022/0049559 A1 Feb. 17, 2022

(30) Foreign Application Priority Data

Feb. 25, 2019 (EP) ..... 19159138
Jul. 4, 2019 (GB) ..... 1909624

(51) Int. Cl.
*E21B 17/01* (2006.01)
*E21B 19/00* (2006.01)

(52) U.S. Cl.
CPC ..... *E21B 19/006* (2013.01); *E21B 17/01* (2013.01)

(58) Field of Classification Search
CPC ..... E21B 17/01; E21B 19/006
See application file for complete search history.

(56) References Cited

U.S. PATENT DOCUMENTS 4,694,909 A * 9/1987 Stephenson ..... E21B 19/006 166/356
6,343,893 B1 * 2/2002 Gleditsch ..... E21B 19/002 114/264
6,470,969 B1 10/2002 Sorhaug et al.
6,691,784 B1 * 2/2004 Wanvik ..... E21B 19/002 166/346

(Continued)

FOREIGN PATENT DOCUMENTS

EP 1103459 A1 5/2001
GB 2358032 A * 7/2001 ..... E21B 33/064

(Continued)

OTHER PUBLICATIONS

PCT International Search Report and Written Opinion, PCT/EP2020/052703, dated Apr. 30, 2020, 12 pages.

*Primary Examiner* — Matthew R Buck
(74) *Attorney, Agent, or Firm* — Quarles & Brady LLP

(57) ABSTRACT

A platform assembly for providing a work area around a well riser is disclosed. The platform assembly comprises a platform configured to be attached to the well riser. The platform assembly further comprises a plurality of tensioning means for supporting the platform relative to a vessel and for supporting the riser. At least part of tensioning means is configured to change in length relative to another part of tensioning means responsive to angular motion of the riser and the vessel.

20 Claims, 20 Drawing Sheets

(56) References Cited

U.S. PATENT DOCUMENTS

| | | | | |
|---|---|---|---|---|
| 9,051,783 | B2 * | 6/2015 | Croatto | E21B 19/006 |
| 9,222,317 | B2 * | 12/2015 | Yemington | E21B 19/002 |
| 9,611,706 | B2 * | 4/2017 | Pinckard | E21B 19/006 |
| 11,002,089 | B2 * | 5/2021 | Wright | E21B 19/09 |
| 11,053,753 | B2 * | 7/2021 | Wijning | E21B 19/22 |
| 2017/0341717 | A1 | 11/2017 | Roodenburg et al. | |

FOREIGN PATENT DOCUMENTS

| | | | | |
|---|---|---|---|---|
| WO | WO-2004013452 | A1 * | 2/2004 | E21B 19/006 |
| WO | 2011008835 | A2 | 1/2011 | |

* cited by examiner

PLATFORM ASSEMBLY

CROSS REFERENCE TO RELATED APPLICATIONS

This application represents the U.S. national stage entry of International Application No. PCT/EP2020/052703 filed Feb. 4, 2020, which claims priority to European Patent Application No. 19159138.7 filed Feb. 25, 2019, and United Kingdom Patent Application No. 1909624.7 filed Jul. 4, 2019, the disclosures of which are incorporated herein by reference in their entirety and for all purposes.

The present invention relates to a platform assembly for a sea vessel, and particularly to a platform assembly having a stabilising mechanism for use on a monohull sea vessel.

BACKGROUND

To intervene inside a subsea well, a riser is built from a subsea stack of the well to a surface flow tree. The riser is held, under tension, by equipment on board a vessel to maintain the riser in an upright configuration. The riser passes through an aperture in a hull of the vessel, referred to as a moon pool, which is located at or near a roll centre of the vessel. The vessel is dynamically positioned on the surface of the sea so that the riser remains vertical and is held within the confines of the moon pool.

Tools may be inserted into and withdrawn from the well through an opening at the top of the riser. The tools may be used to inspect or service the well. Some examples of such tools are wireline and slickline tools, and coiled tubing injection tools.

As the surface of the sea causes the vessel to move relative to the riser, which is fixed at its base to the oil well, the decks of the ship correspondingly move relative to the end of the riser, which may have additional machinery mounted thereto. Workers trying to work at the top end of the riser therefore have to cope with the ship pitching, rolling, yawing, and heaving relative to the top end of the riser. This relative motion presents a safety risk to the workers trying to work at the riser.

Risers are known which are supported by a tension frame which is suspended, by wires, from a guided hook. The hook is mounted on a derrick or tower, which is fixed to the vessel. The wires are attached to a heave compensation system which maintains tension in the riser as the vessel rises and falls, i.e. heaves, on the surface of the sea. The tension frame has a platform which is arranged around the riser to provide a working area for workers. The tension frame has a top and bottom crossbeam and two side members, the hook being attached to the top crossbeam and the riser to the bottom crossbeam providing space between side members to apply the tools to the top of the riser. The tension frame has to be tall enough to accommodate the tallest tools. As the vessel pitches and rolls the tension frame rotates about the connection with the hook and the bottom of the tension frame remains aligned with the riser.

Tension frames must be scaled in size according to the largest tool to be inserted or withdrawn from the riser. The larger the tension frame, the larger the tower and the larger the translation of the riser relative to the sides of the moon pool for a given angular change at the hook. This means that, for safe stabilisation of larger tension frame arrangements, larger moon pools are required.

Conventional monohull vessels and semi-submersible vessels can both accommodate moon pools. Monohull vessels are less expensive and more manoeuvrable than semi-submersible vessels, but cannot accommodate large moon pools and, for a given sea state, monohull vessels are moved more by the sea than semi-submersible vessels.

Other systems are known to comprise a heave compensated platform, which rises and falls on a slide attached to the vessel.

Risers comprising a flexible joint are known, which enables the top of such risers to pivot with the platform. Such joints are expensive and heavy.

Gimbal devices are known which attempt to stabilise the platform as the vessel pitches and rolls. Such gimbal devices effectively move the point at which the riser pivots from the hook high above the platform to the location of the gimbal, thereby reducing the translation of the riser relative to the moon pool and reducing the size of the moon pool required. However, known gimbal devices are heavy and take up significant space in the work area at the top of the riser. Further, such devices cause the platform and the top of the riser, together with any machinery attached thereto, to move relative to each other and therefore make working on the equipment more hazardous.

It is an aim of the present invention to overcome one or more of the above problems associated with the prior art. The present invention is preferably to be used in combination with a monohull vessel, though other uses of the invention are determinable by the skilled person.

STATEMENT OF INVENTION

The invention provides a platform assembly for providing a work area around a well riser, the assembly comprising: a platform configured to be attached to the well riser; and tensioning means for tensioning the platform relative to a vessel and applying a tension force for supporting the riser, wherein the tensioning means is adapted to apply a respective tension force at each of a plurality of locations on the platform, and at least one first part of the tensioning means is adapted to change in length in response to angular movement of the vessel relative to the riser.

By providing such a platform assembly, a tension supplied to the platform and riser may be kept uniform while the platform assembly remains fixed relative to the riser, thereby providing a safer working area for workers, while avoiding the application of damaging bending torques to the riser as a result of angular movement of the vessel relative to the riser.

The tensioning means may comprise at least one flexible tension applying member adapted to apply substantially the same tension to a plurality of said locations on the platform.

The tensioning means may further comprise a plurality of first sheaves adapted to be mounted to the platform and at least one said flexible tension applying member may be adapted to apply a tension to a plurality of said first sheaves.

This provides the advantage of enabling, by means of a simple construction, substantially the same tension to be applied at a plurality of locations on the platform, while accommodating angular movement of the vessel relative to the platform.

At least one said first part of the tensioning means may comprise a respective part of a said flexible tension applying member extending between a said first sheave and the vessel.

The tensioning means may further comprise a plurality of second sheaves adapted to be mounted to the vessel and at least one said flexible tension applying member may adapted to apply a tension to a plurality of said second sheaves.

The tensioning means may comprise a plurality of tension applying members interconnected to apply substantially the same tension to a plurality of said locations on the platform. A plurality of said tension applying members may be flexible.

A plurality of said flexible tension applying members may be connected in series.

The platform assembly may further comprise connecting means for connecting the platform to the vessel, wherein the platform is restrained against movement parallel to first and second axes, and is able to move parallel to a third axis, wherein the first, second and third axes are substantially perpendicular to each other.

The platform may be restrained from pivoting about the third axis but may be able to pivot about the first and second axes.

The connecting means may comprise a first joint configured to mount the platform to the vessel, a second joint configured to mount a rigid member to the vessel, and a third joint configured to mount the rigid member to the platform.

This provides the advantage of avoiding the need for a gimbal mechanism in a central region of the platform assembly, thereby avoiding obstructing the insertion of tools into the riser and enabling a simplified construction of platform assembly.

At least one joint may be a rose joint.

This provides the advantage of enabling the range of relative motion of the platform assembly and the vessel to be in accordance with the parameters of the joints.

At least one first part of the tensioning means may comprise at least one respective hydraulic cylinder.

At least two of the plurality of hydraulic cylinders may be in fluid communication with one another.

Hydraulic cylinders able to communicate fluid to one another while transmitting tension to the platform provide a simple and passive mechanism for equalising tension supplied to those parts of the platform at which the cylinders are located.

The plurality of hydraulic cylinders may be so linked in hydraulic communication as to enable the platform to pivot about first and second axes relative to the vessel, wherein said first and second axes are substantially perpendicular to each other.

This provides the advantage of increasing the freedom of movement of the platform relative to the vessel, thereby reducing the likelihood of relative motion of the riser and the platform causing a bending moment to be applied to the platform and correspondingly reducing the likelihood of damage to the platform assembly or riser.

The platform assembly may further comprise fluid control means for controlling a fluid volume of at least one hydraulic cylinder.

This enables the fluid volumes of particular hydraulic cylinders to be individually controlled, providing the advantage of increasing the control provided over the tensions supplied to the platform assembly.

The platform assembly may further comprise at least one sensor for determining at least one of: (i) an angle between the platform and the vessel; (ii) a fluid volume of at least one hydraulic cylinder; and (iii) a fluid pressure of at least one hydraulic cylinder.

This increases the amount of information available to a controller of the platform assembly's orientation relative to the vessel, thereby providing the advantage of improving the ability of the controller to accurately control the relative orientation.

The fluid control means may be configured to change a fluid volume of at least one hydraulic cylinder responsive to a determination of at least one sensor.

This enables the tensions supplied to the platform assembly to be automated, which improves the safety of the platform assembly as the platform assembly is able to respond to changing conditions more quickly and reliably.

The platform assembly may further comprise at least one fluid flow control valve for controlling a flow of fluid into or out of at least one hydraulic cylinder.

This provides the advantage of enabling the tension balancing to be tailored, such as enabling the relative motion of the platform and the vessel to be damped to a degree determined by the valves.

At least one fluid flow control valve may be configured to be closed for enabling the platform to be kept stationary relative to the vessel.

This enables the platform to be fixed in position relative to the vessel, providing the advantage of enabling the platform to be used in circumstances where the platform is not fixed to the riser.

The tensioning means may be adapted to control a height of the platform relative to the vessel in response to movement of the vessel.

This provides the advantage of enabling operation of the assembly to be simplified, by providing a common vertical reference from which the tensioning means can vary the angle of the platform.

The tensioning means may comprise at least one respective tensile member connected to each of a plurality of locations on said assembly, wherein vertical motion of said tensile members is synchronised in use.

The platform assembly may be slideably moveable relative to the vessel along rails.

This provides the advantage of preventing the platform assembly from translating relative to the vessel thereby protecting the riser from impacting on an edge of a moon pool of the vessel, whilst allowing the platform to remain attached to the riser whilst the vessel heaves up and down.

LIST OF FIGURES

Embodiments of the present invention will now be described by way of example only and not in any limitative sense with reference to the accompanying drawings, in which.

Figure 16:
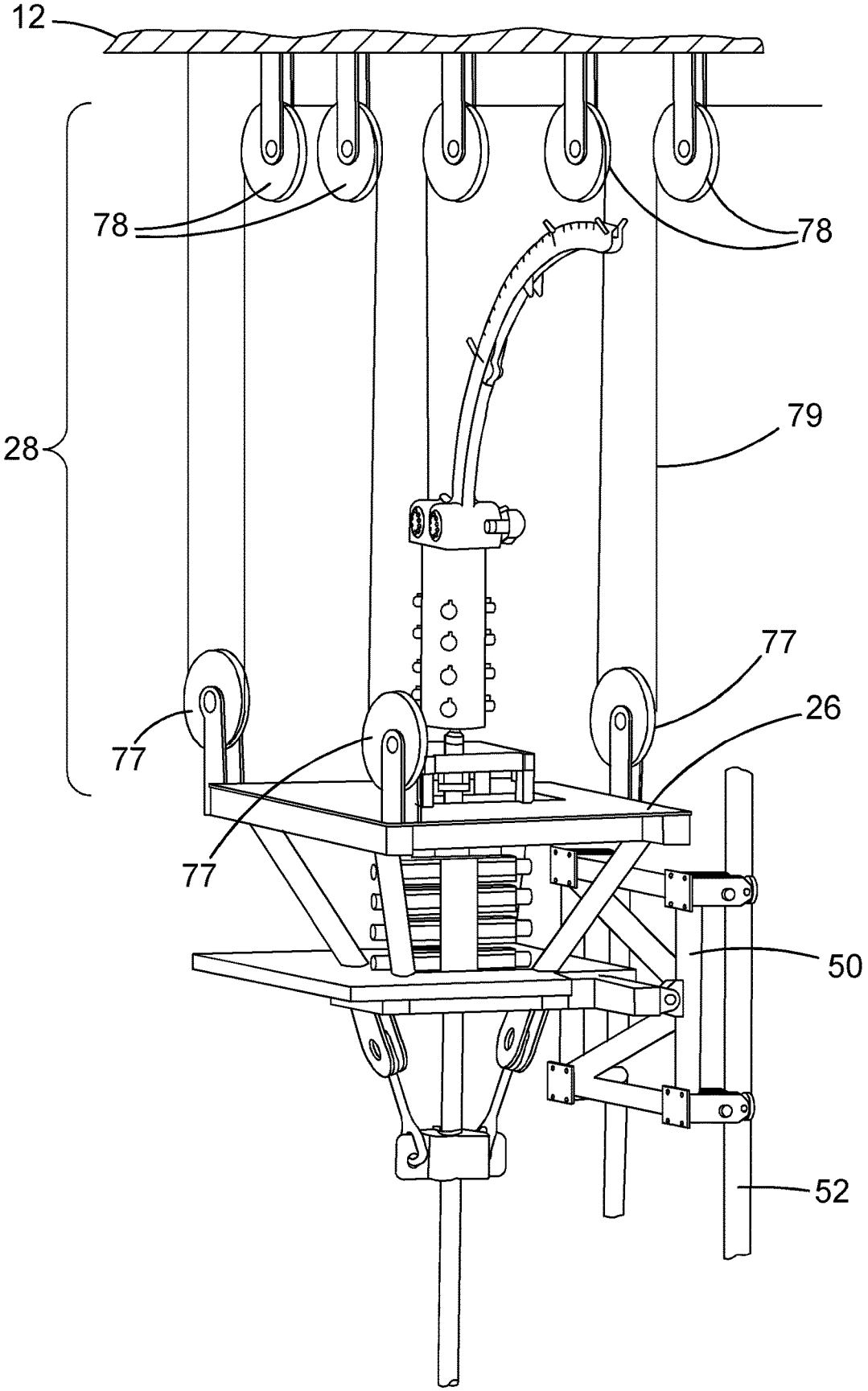
Figure 17:
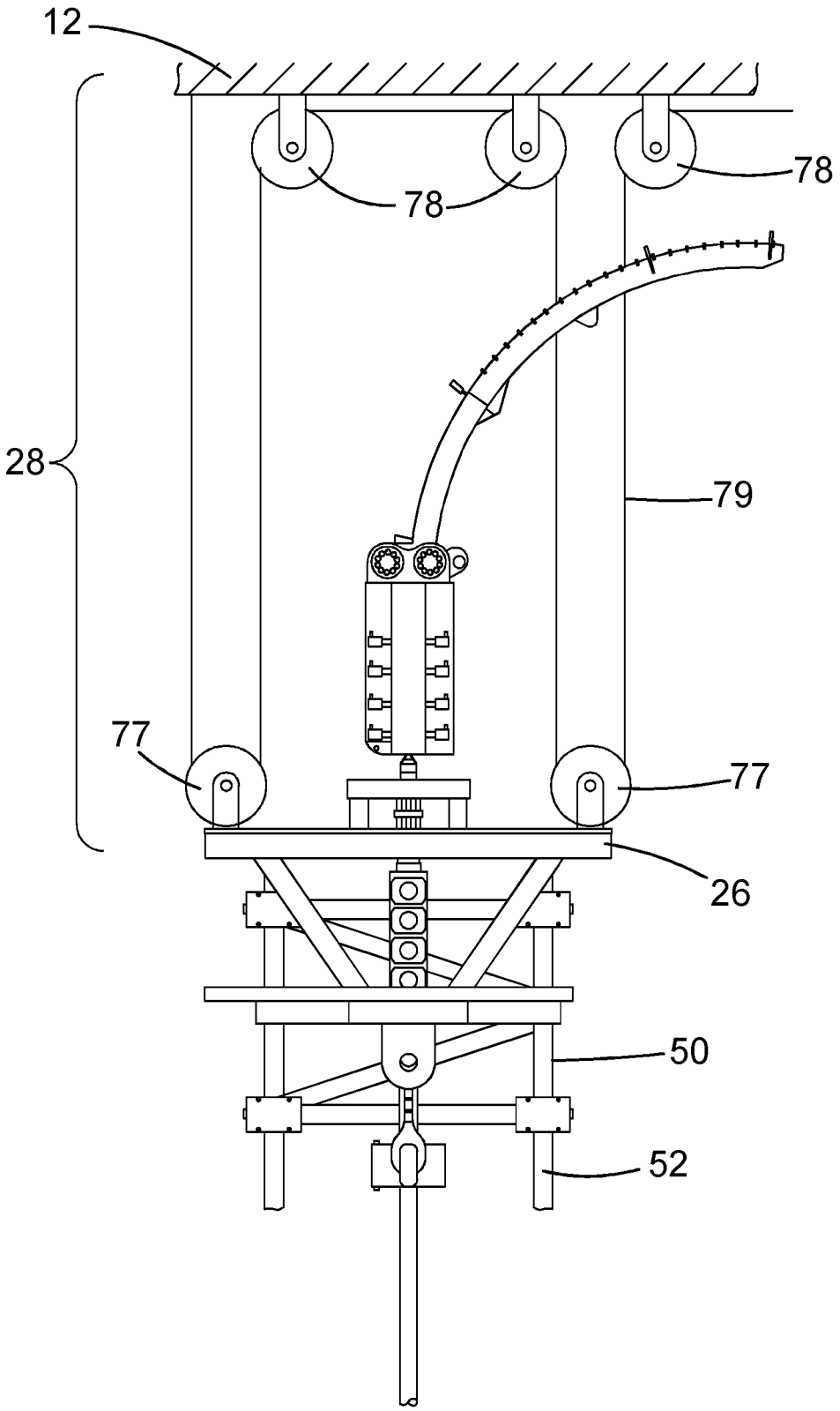
Figure 18:
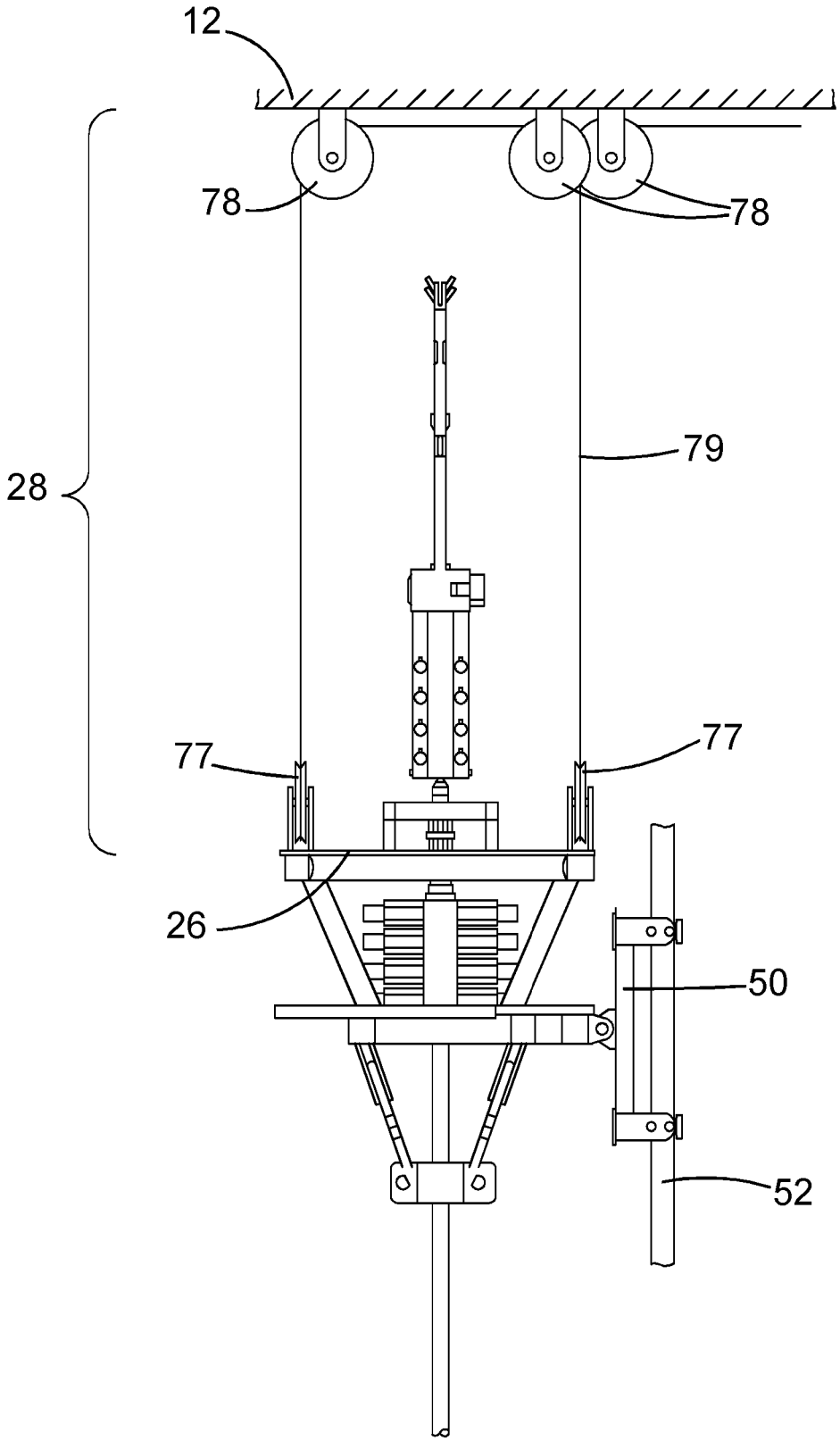
Figure 19:
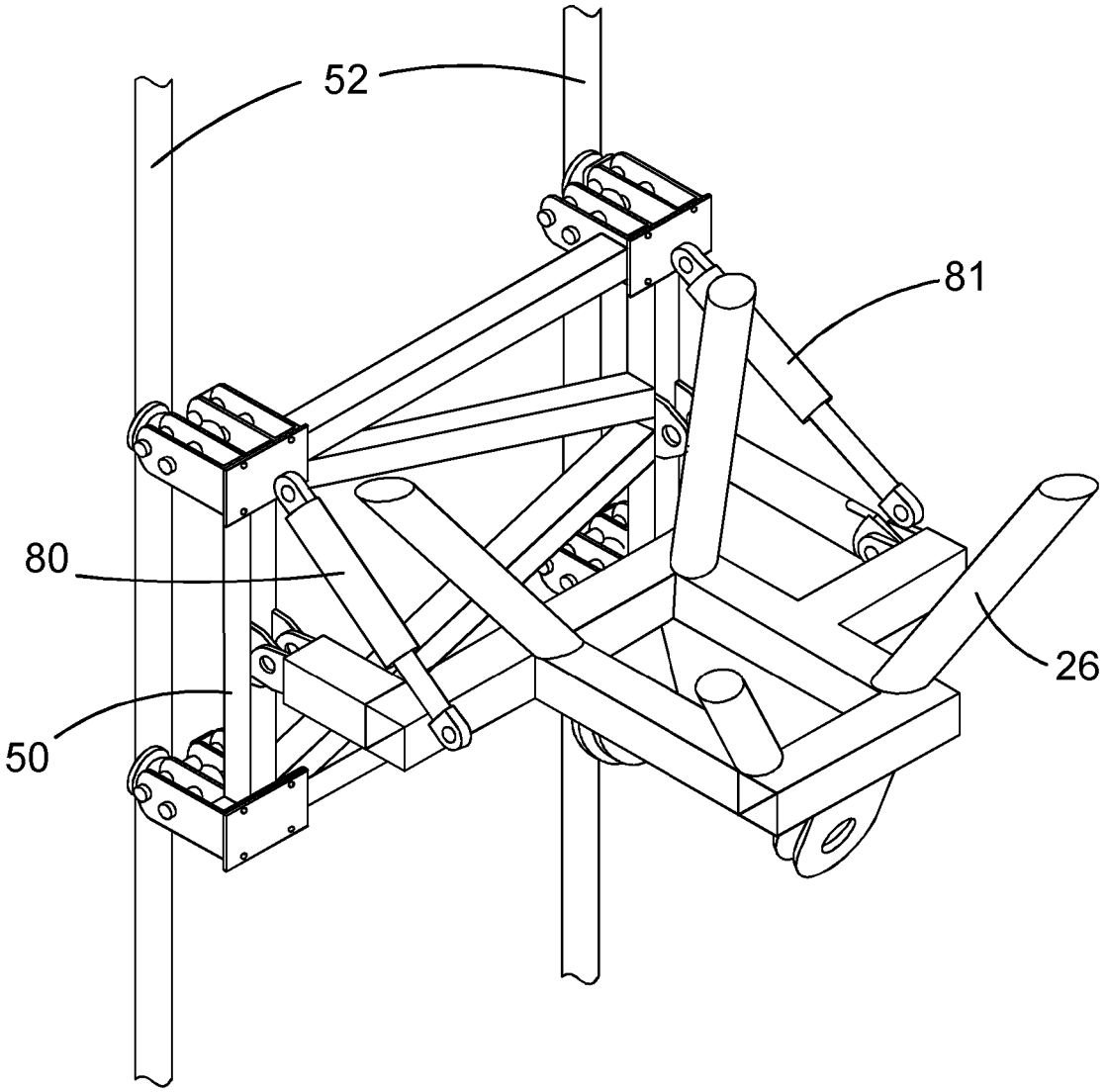
Figure 20:
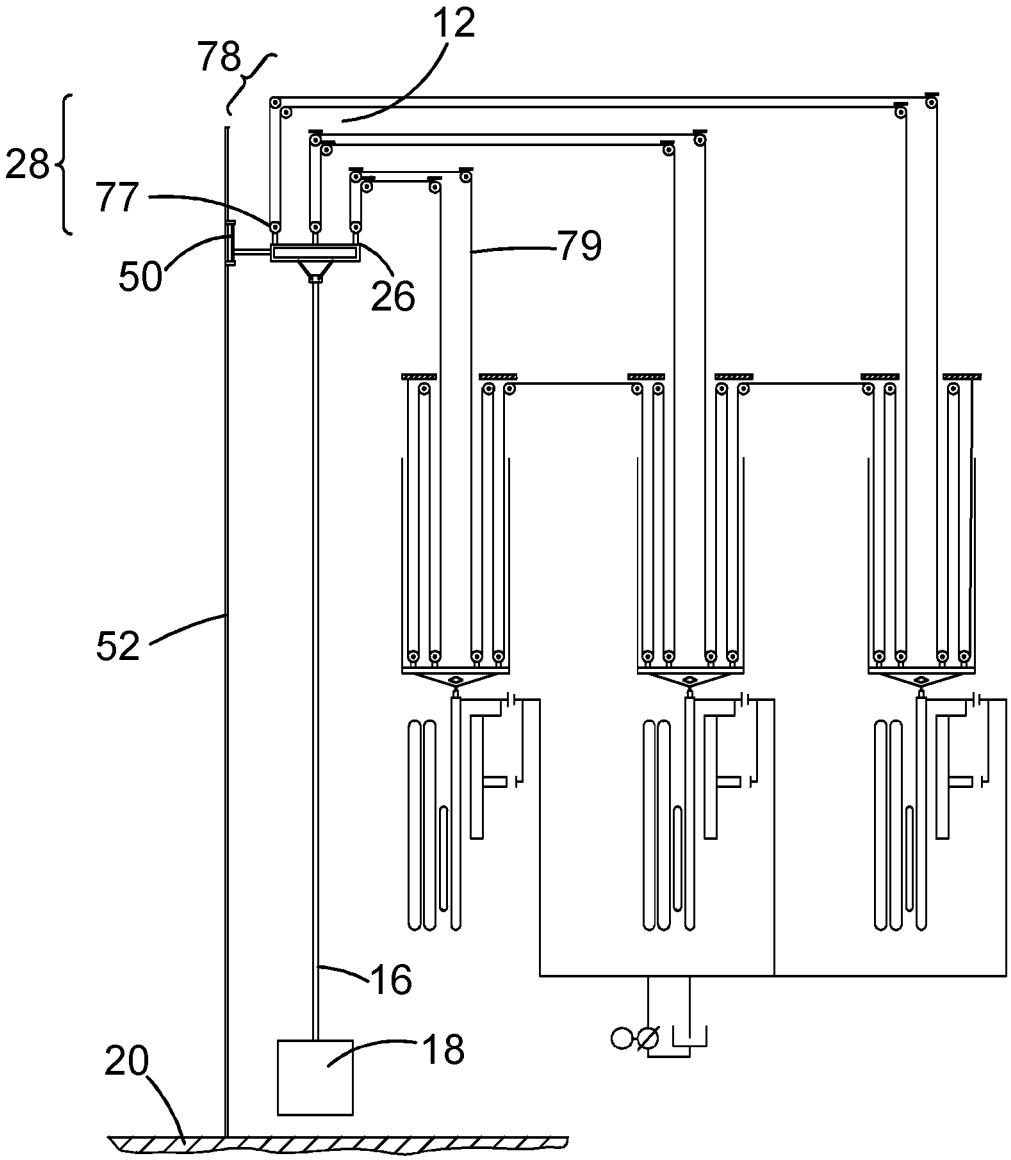

FIG. 16 is a perspective view of a platform assembly of a second embodiment of the present invention; and FIG. 17 is a side view of a platform assembly of a second embodiment of the present invention; and FIG. 18 is a front view of a platform assembly of a second embodiment of the present invention; and FIG. 19 is a perspective view on a platform assembly of a second embodiment of the present invention with the platform cut away to show the locking cylinders; and FIG. 20 is a schematic view of the platform assembly of FIG. 16 showing operation of the tensioning means.

REFERENCE NUMERAL INDEX

Figure 1:
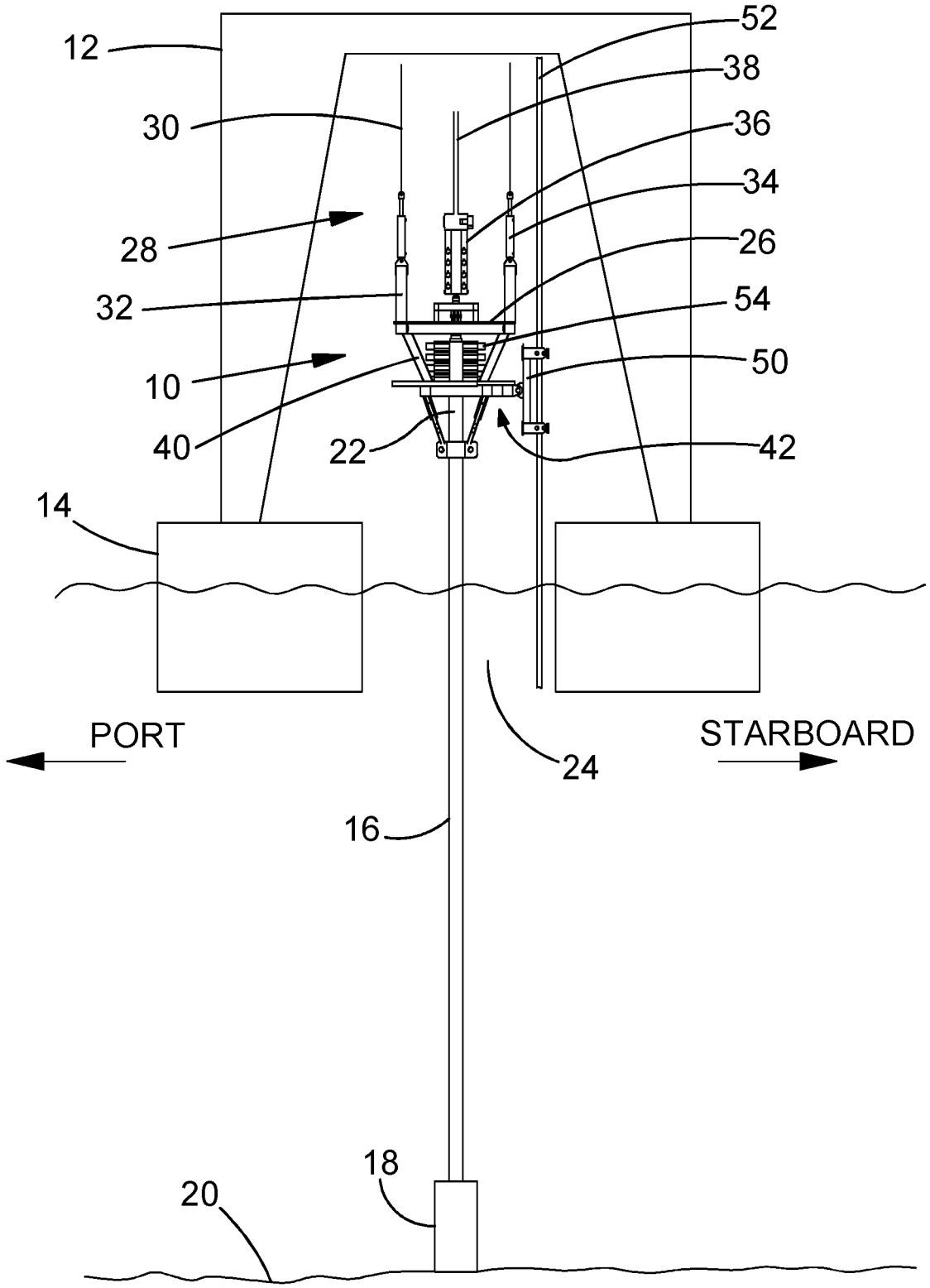
FIG. 1 is a cross-sectional side view of a platform assembly of a first embodiment of the present invention installed on a vessel at sea.
Figure 2:
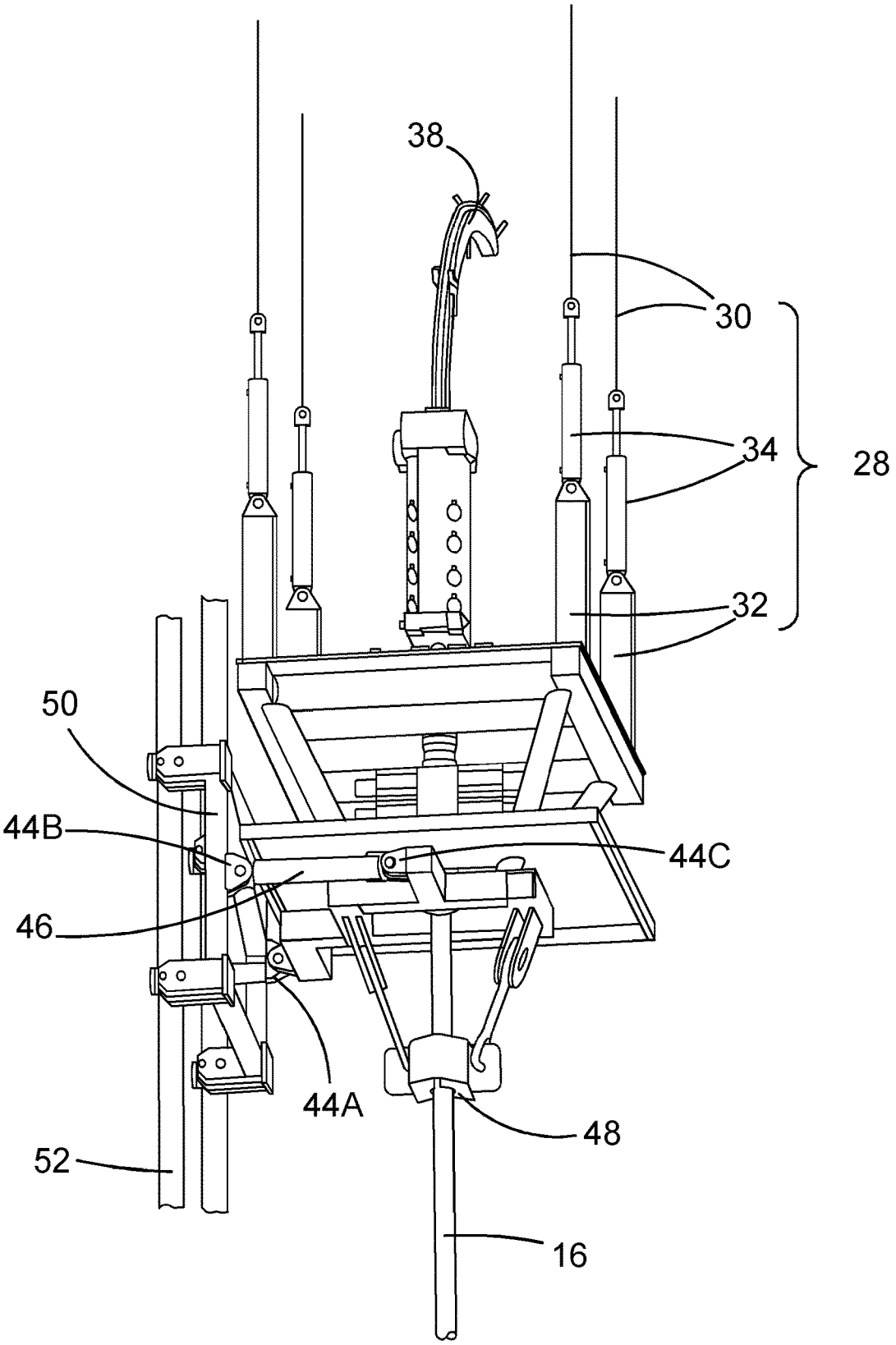
FIG. 2 is a lower isometric view of the platform assembly of FIG. 1.
Figure 3:
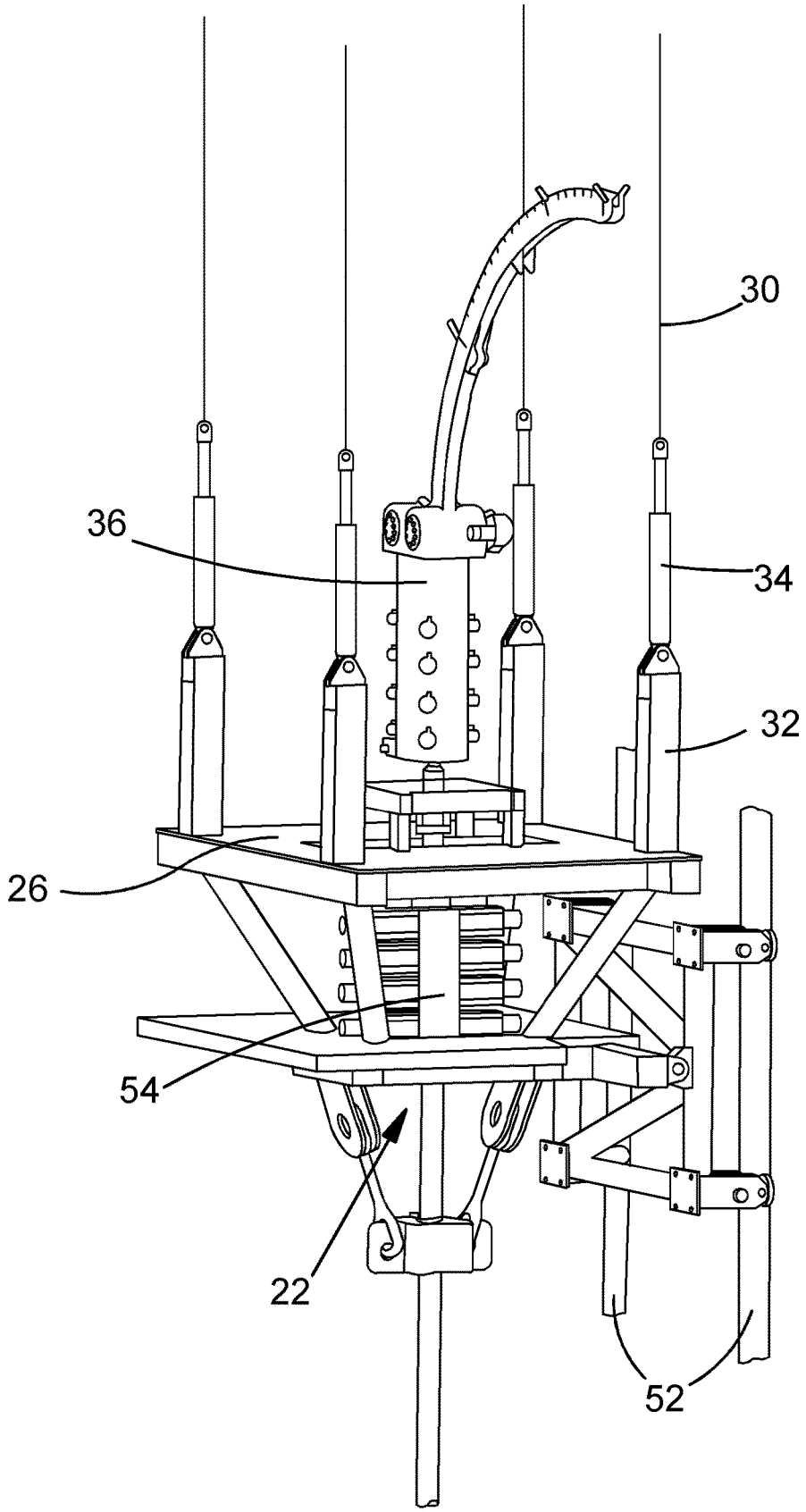
FIG. 3 is an upper isometric view of the platform assembly of FIG. 1.
Figure 4:
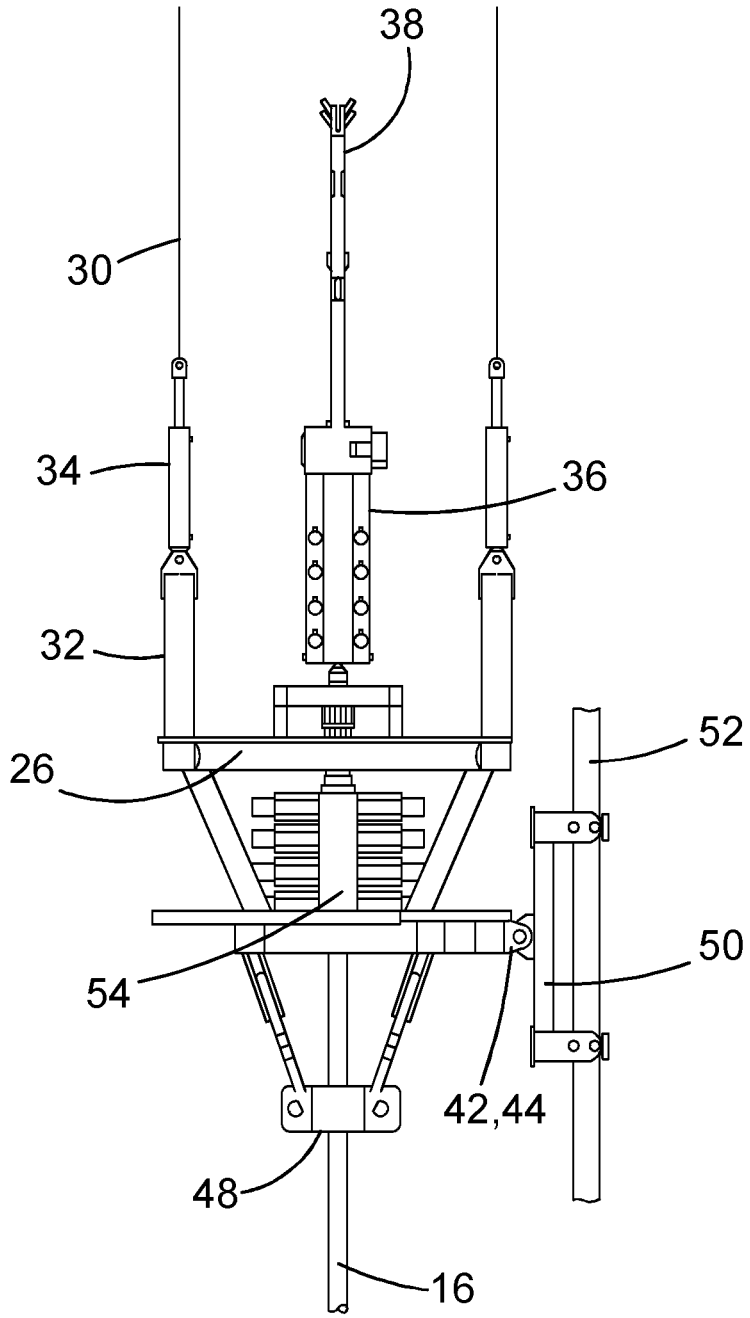
FIG. 4 is a side view of the platform assembly of FIG. 1.
Figure 5:
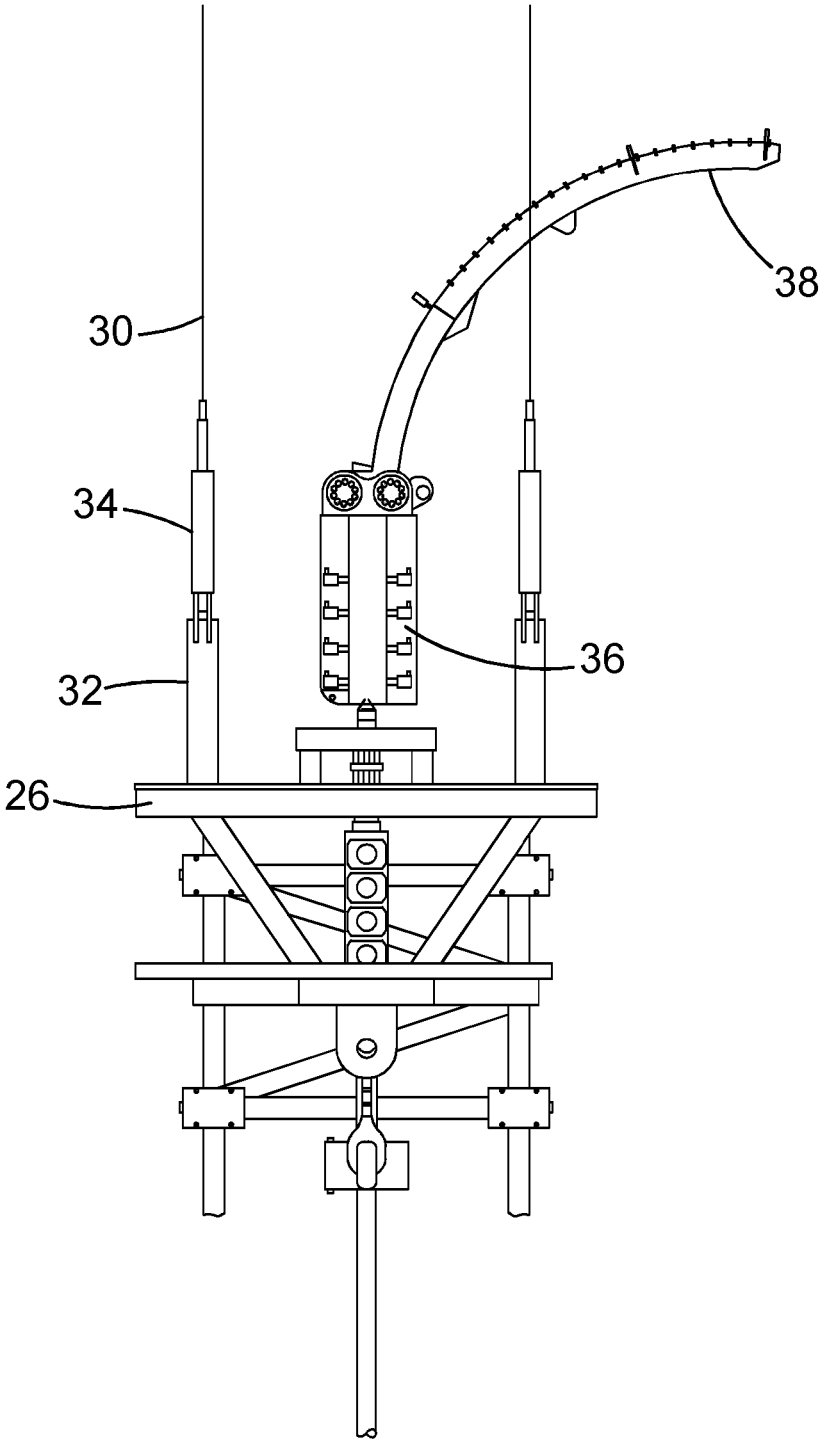
FIG. 5 is a front view of the platform assembly of FIG. 1.
Figure 6:
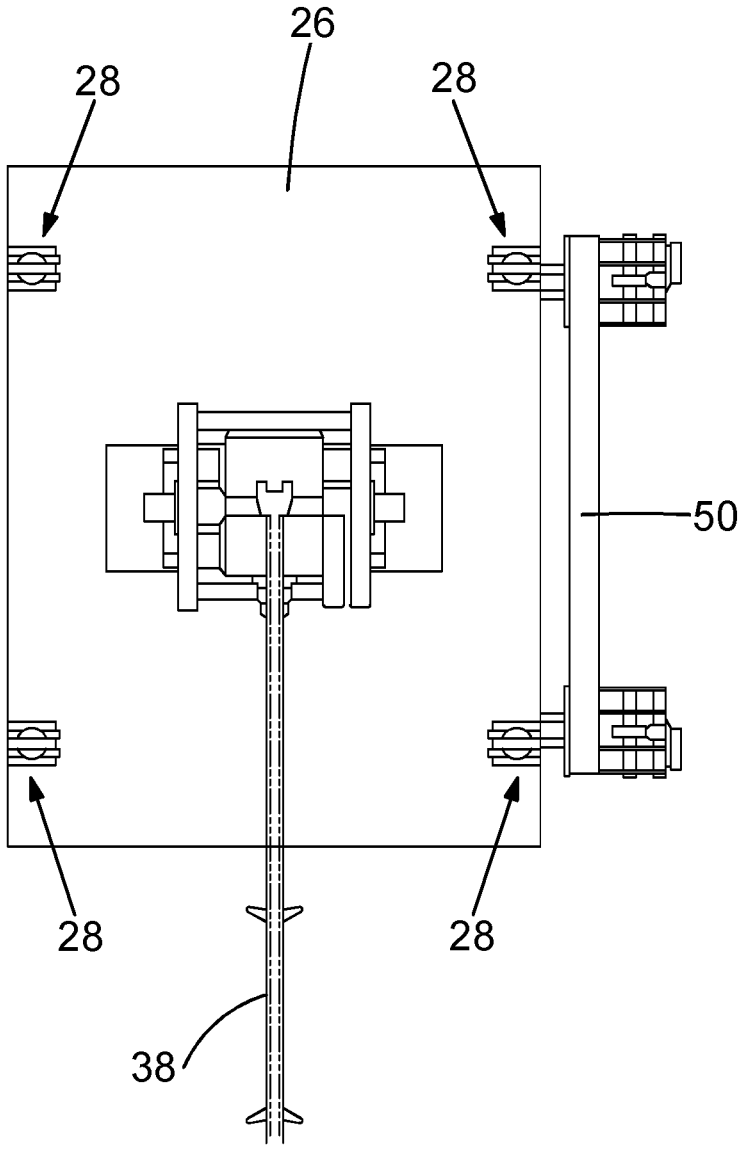
FIG. 6 is a plan view of the platform assembly of FIG. 1.

10 Platform assembly
12 Derrick
14 Vessel
16 Riser
18 Subsea stack
20 Sea bed
22 Working end of riser
24 Moon pool
26 Platform
28 Tensioning means
30 Wires
32 Upwardly-extending beams
34 Hydraulic cylinders
36 Coiled tubing injector
38 Coiled tubing bend restrictor
40 Support frame
42 Connector means
44 Joints
46 Rod
48 Clamp
50 Sliding frame
52 Rails
54 Surface flow tree
56 Hydraulic circuit
58 First hydraulic path
60 Second hydraulic path
62 First control valve
64 Second control valve
66 Pilot line
68 First end of rod
70 Second end of rod
72 Ram rig
74 Carriage
76 Heave compensation system
77 First Sheave
78 Second Sheave
79 Tension applying member
80 First locking cylinder
||Second locking cylinder
HA Hinge axis
PORT Port side of the vessel
STARBOARD Starboard side of the vessel Referring to FIG. 1, a platform assembly 10 is shown supported from a derrick 12 of a vessel 14. The platform assembly 10 is mounted to a riser 16. The riser 16 connects a subsea stack 18 at the sea bed 20 to machinery which is attached to a working end 22 of the riser 16. The vessel 14 is shown having a moon pool 24 extending through the vessel's hull.

Referring to FIGS. 1 to 12 and 2 to 6 in particular, the platform assembly 10 is shown comprising a platform 26 and tensioning means 28 for providing tension to the platform 26 from the derrick 12. The tensioning means 28 comprises flexible tensile members in the form of wires 30 extending from the derrick, rigid tensioning means in the form of beams 32 extending upwardly from the platform and hydraulic cylinders 34 connecting the wires to upper ends of the upwardly-extending beams 32. Also shown are a coiled tubing injector 36 tube and coiled tubing bend restrictor 38.

Referring to FIGS. 1 to 12 and 7 to 12 in particular, the platform assembly 10 is shown having a support frame 40, connector means 42 in the form of three joints 44A, 44B, 44C, which may be rose joints, and a link arm in the form of a rigid rod 46, and a riser gripping device in the form of a clamp 48 for gripping an exterior of the riser 16 to maintain the platform 26 in a fixed position relative to the riser 16. A rose joint, sometimes referred to as a rod end bearing or heim joint, is a spherical bearing which allows rotation about a pivot pin and an amount of rotational alignment in any other plane proportional to the dimensions of the joint. The clamp 48 may be adapted to bring in riser pipes to build the riser 16 while the riser 16 is held in slips attached to moon pool doors.

The platform assembly 10 is shown having a sliding frame 50 which is mounted to a pair of rails 52 and connected to the support frame 40 via the three joints 44A, 44B, 44C and rigid rod 46. The sliding frame 50, and thus the platform assembly 10, may slide along the rails 52. The rails 52 are fixed relative to the vessel 14 and are shown extending into the moon pool 24 of the vessel.

Figure 15:
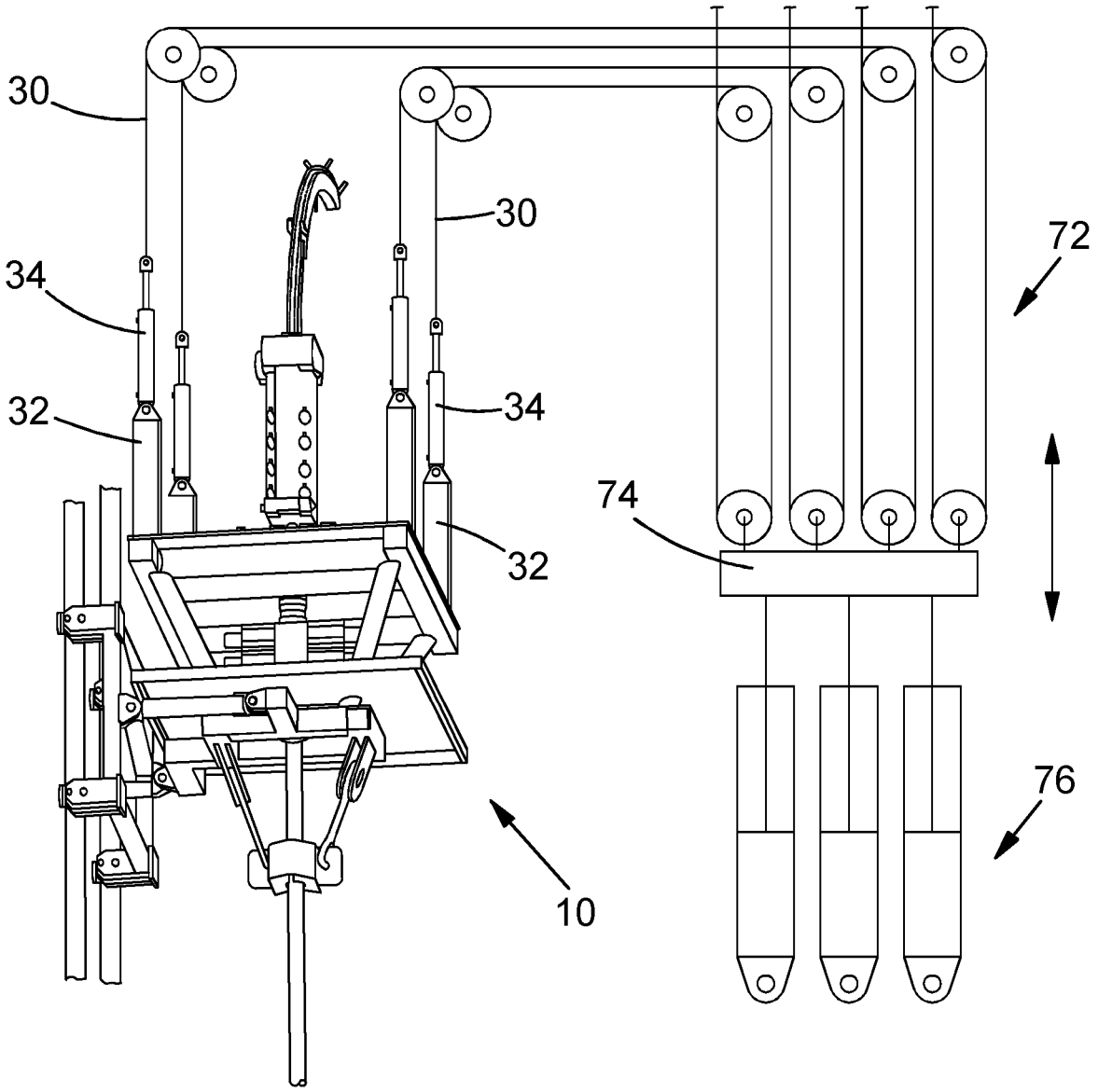
FIG. 15 is a perspective view of the platform assembly of FIG. 1 showing more details of the tensioning means.

As shown in greater detail in FIG. 15, the wires 30 are connected via a ram rig 72 and carriage 74 to a heave compensation system 76 which maintains as constant a tension in the wires 30 as reasonably practicable as the platform 26 slides along the rails 52 due to the vessel 14 rising and falling with the surface of the sea. The heave compensation system may have one or more of an active heave compensation system and a passive heave compensation system. The passive system may be used when the riser 16 is attached to the subsea stack 18 and the active system may be used to make the connection.

The vertical motion of the wires 30 is synchronised in response to the heave compensation system 76. The wires 30 are attached to a single carriage 74 on the ram-rig system 72 to lift and lower the platform. Synchronising vertical motion of the wires 30 provides a common vertical reference from which the tensioning means can vary the angle of the platform 26, thereby simplifying operation of the platform assembly 10. Alternatively motion of the wires 30 may be synchronised by attaching all of the wires to a single winch drum, or by attaching the wires 30 to separate winch drums which are themselves synchronised.

Also shown is a surface flow tree 54 mounted to the riser 16 within the confines of the support frame 40, which is shown beneath the working area of the platform 26.

The coiled tubing injector tool 36 and surface flow tree 54 are examples of machinery which may be attached to the working end 22 of the riser 16, and it is to be understood that other equipment may be attached to the riser 16 and used in combination with the platform assembly of the present invention.

The hydraulic cylinders 34 are shown in FIGS. 1 to 6 connected between the wires 30 and the upwardly-extending beams 32, but one or more of the hydraulic cylinders 34 may be integrated into respective one or more beams 32. Alternatively, one or more hydraulic cylinders 34 may be directly connected to the platform 26 in absence of respective one or more beams 32. In the embodiment of the invention shown in these Figures, there are four sets of wires 30, hydraulic cylinders 34, and beams 32, but it is to be understood that sets of different numbers of wires, cylinders, and beams are possible.

The hydraulic cylinders 34 may be connected to one another in hydraulic communication. In a preferred embodiment, there are four hydraulic cylinders 34 in hydraulic communication which takes the form of a hydraulic circuit 56 illustrated schematically in FIG. 13.

Figure 13:
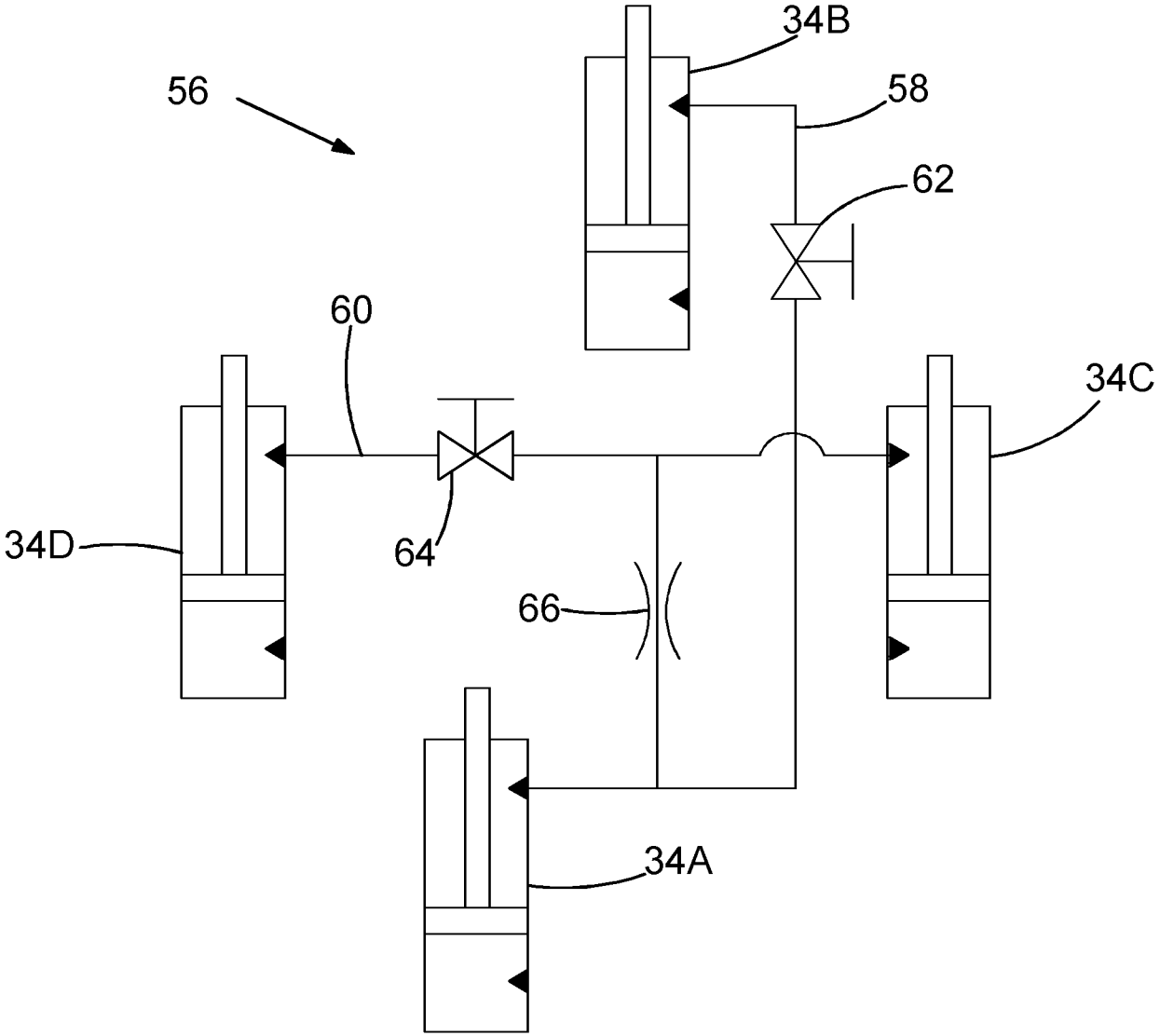
FIG. 13 is a schematic drawing of a hydraulic circuit according to an embodiment of the invention.

Shown in FIG. 13 are first 34A, 34B and second 34C, 34D pairs of hydraulic cylinders 34. The cylinders 34A, 34B of the first pair are arranged at opposite corners of the platform 26, and are hydraulically connected to one another by a first hydraulic path 58 to allow fluid to flow from either cylinder 34A, 34B to the other 34B, 34A. Similarly, the cylinders 34C, 34D of the second pair are arranged opposite one another at the remaining corners of the platform 26 and are hydraulically connected by a second hydraulic path 60 in the same manner as the first pair. Each pair of cylinders 34A-34D is connected via a respective control valve 62, 64 which controls the rate of flow of fluid.

The two hydraulic paths 58, 60 between each pair of cylinders may be connected by a hydraulic line 66, such as a low flow capacity pilot line. This pilot line 66 balances the pressures between each of the hydraulic paths 58 and 60 to ensure that the load is shared evenly between the four lift wires 30. System redundancy is provided by restricting the maximum flow in the pilot line 66, which only needs a small flow in operation to balance the pressures, so that if there is a failure in one of the hydraulic paths 58, 60 or cylinders 34 the two opposite wires can maintain their load.

The fluid flow control valves 62, 64 may be closed to prevent fluid flow between the pairs of cylinders 34. This enables the angle of the platform 26 to be kept constant relative to the vessel 14 in circumstances where this is desirable, such as when the platform 26 is not attached to the riser 16.

Instead of or in addition to providing hydraulic paths, fluid volumes in the cylinders 34 may be individually controlled by appropriate flow control equipment to achieve and/or maintain any desired angle of the platform. The angle may be achieved and/or maintained by using sensors (not shown) to measure the relative angle of the vessel and platform and/or the position of the cylinders 34 and/or the fluid pressures in the cylinders 34, calculating a desired position, and commanding the flow control equipment to position the platform 26 in the desired position. This may be performed with a closed loop control system.

The operation of the platform assembly 10 will now be described. With the vessel 14 in a desired location above the subsea stack 18, and the riser 16 secured to the subsea stack 18, an upward tension is to be applied to the riser 16 to maintain the riser 16 upright. The clamp 48 of the platform assembly is installed on the exterior of the riser 16, and appropriate machinery of the vessel 14, preferably via the heave compensation system, applies tension to the wires 30. The applied tension is transferred through the wires 30, hydraulic cylinders 34 and hydraulic fluid therein, upwardly-extending beams 32, platform 26, support frame 40, and the clamp 48 to the riser 16. Once this tension is achieved, the platform 26 provides a working area.

It is necessary that workers on the working area experience as little acceleration as possible as the vessel 14 moves, so that the workers can work safely. Further, as the platform 26 is fixed relative to the riser 16 and held under tension by the wires 30, any motion of the vessel would exert a bending moment on the platform which could cause the platform assembly 10 or the riser 16 to bend or break.

As the vessel 14 pitches and rolls, the volumes of fluid in the hydraulic cylinders 34 change. In the embodiment of FIG. 13, when the vessel 14 tilts so that a corner of the platform 26 at cylinder 34A moves upward relative to the vessel 14 and the opposite corner of the platform 26 at cylinder 34B moves downward relative to the vessel 14 (in other words, the platform 26 rotates relative to the vessel 14 about an axis which is a locus in the plan view of the two points defined by the above two locations), fluid flows from cylinder 34A to cylinder 34B, which causes the length of cylinder 34A to decrease and the length of cylinder 34B to increase accordingly. The remaining two cylinders 34C and 34D work in a similar way. In an embodiment, the four cylinders 34 are so arranged on or above the platform that the axes of rotation they define are orthogonal to one another. This arrangement evenly distributes and shares the load applied about the location where the riser 16 meets the platform 26 and ensures redundancy by enabling a pair of cylinders 34 to support the load if the other pair fails.

As the lengths of the cylinders 34 change in response to movement of the vessel 14 relative to the platform 26, the tensions experienced by the points on the platform 26 where the cylinders 34 or beams 32 are mounted are kept equal (or as close to equal as practicable), thereby maintaining zero bending moment on the platform 26 (or as close to zero as practicable). This prevents workers on the platform 26 from experiencing the pitch and roll of the vessel 14 that would be experienced if they were present on a deck of the vessel 14 and prevents relative motion between the platform 26 and the riser 16, thereby increasing their safety while they work on the platform. It also prevents the platform 26 and riser 16 from experiencing a potentially damaging bending moment.

The platform assembly 10 is slideably connected via the connector means 42 and sliding frame 50 to rails 52 which are mounted on the vessel 14, as shown in FIGS. 1 to 6 and described above. The wires 30 are connected to the heave compensation system which compensates for heave of the vessel, and the co-operation between the sliding frame 50 and rails 52 enables the platform 26 to be mounted to the vessel 14 while heave compensation is provided to the platform assembly.

As the vessel 14 pitches and rolls, the rails 52 correspondingly rotate relative to the platform assembly 10. With no accommodation for this relative motion, the sliding frame 50 and rails 52 apply a bending moment to one another, which can cause damage to both the rails 52 and the platform assembly 10.

The function of the joints 44 and rigid rod 46 of the connector means 42 will now be described with reference to FIGS. 7 to 12. For descriptive purposes only, the starboard and port of the vessel are labelled on FIGS. 8 to 12 as to the right-hand side and left-hand side of the Figures respectively.

Figure 7:
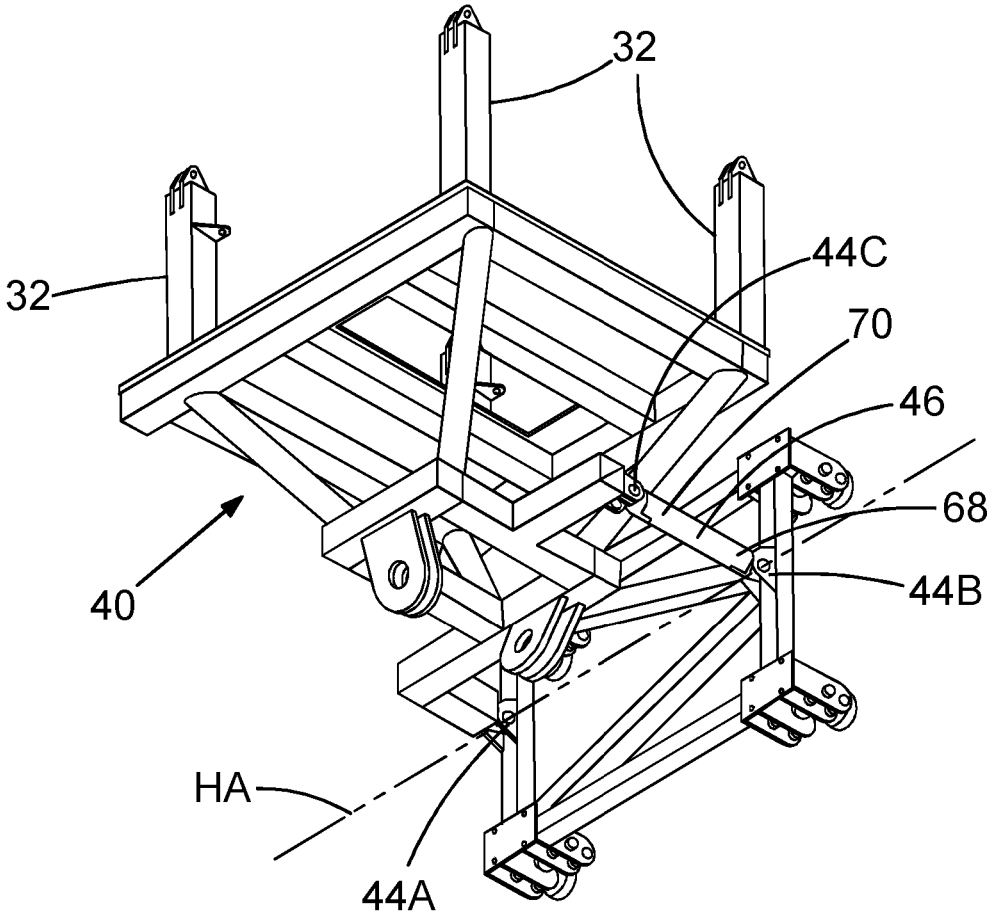
FIG. 7 is a lower isometric view of a part of the framework of the platform assembly of FIG. 1.
Figure 8:
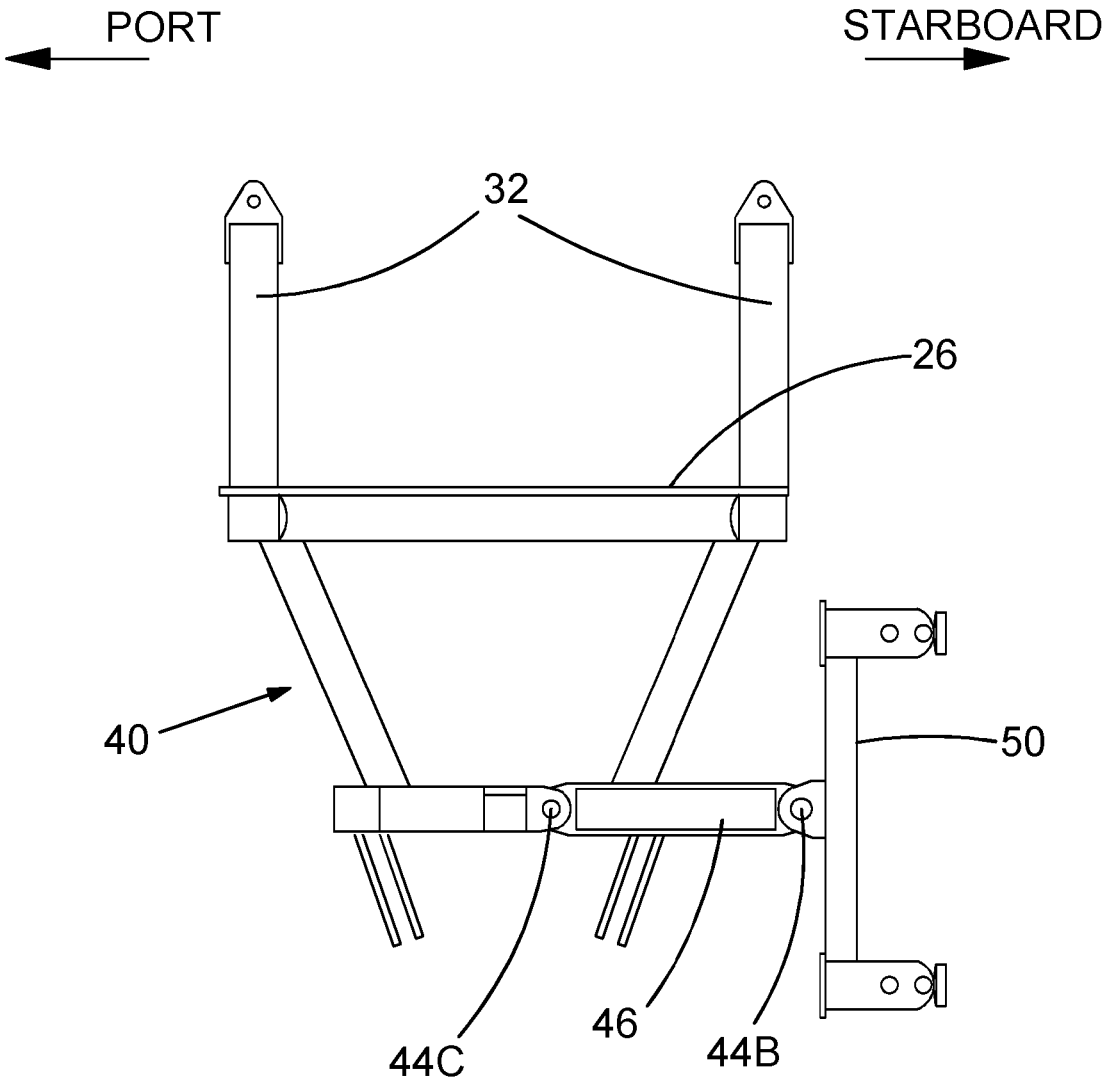
FIG. 8 is a side view of the part shown in FIG. 7 in a first configuration.
Figure 9:
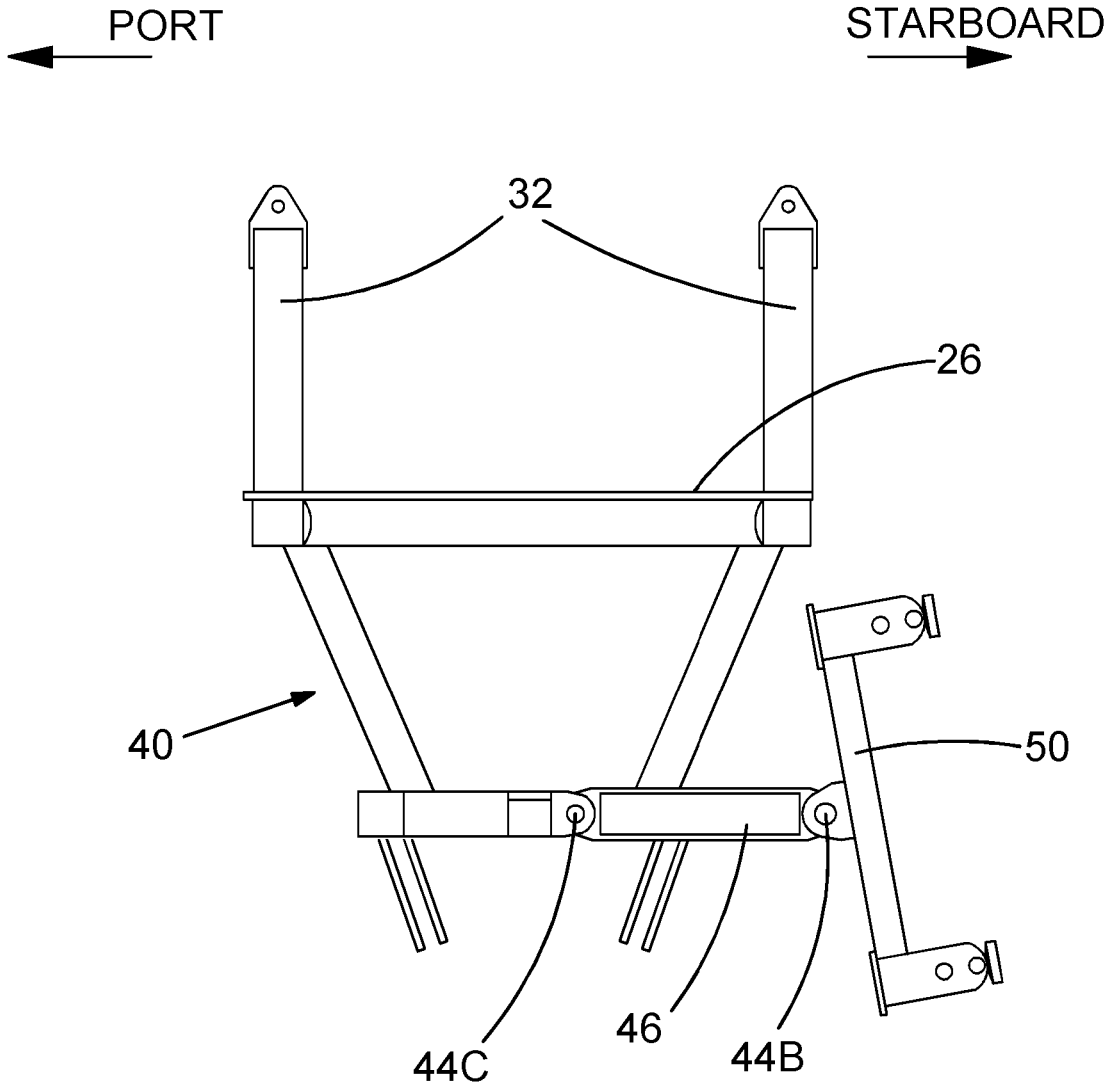
FIG. 9 is a side view of the part shown in FIG. 7 in a second configuration.
Figure 10:
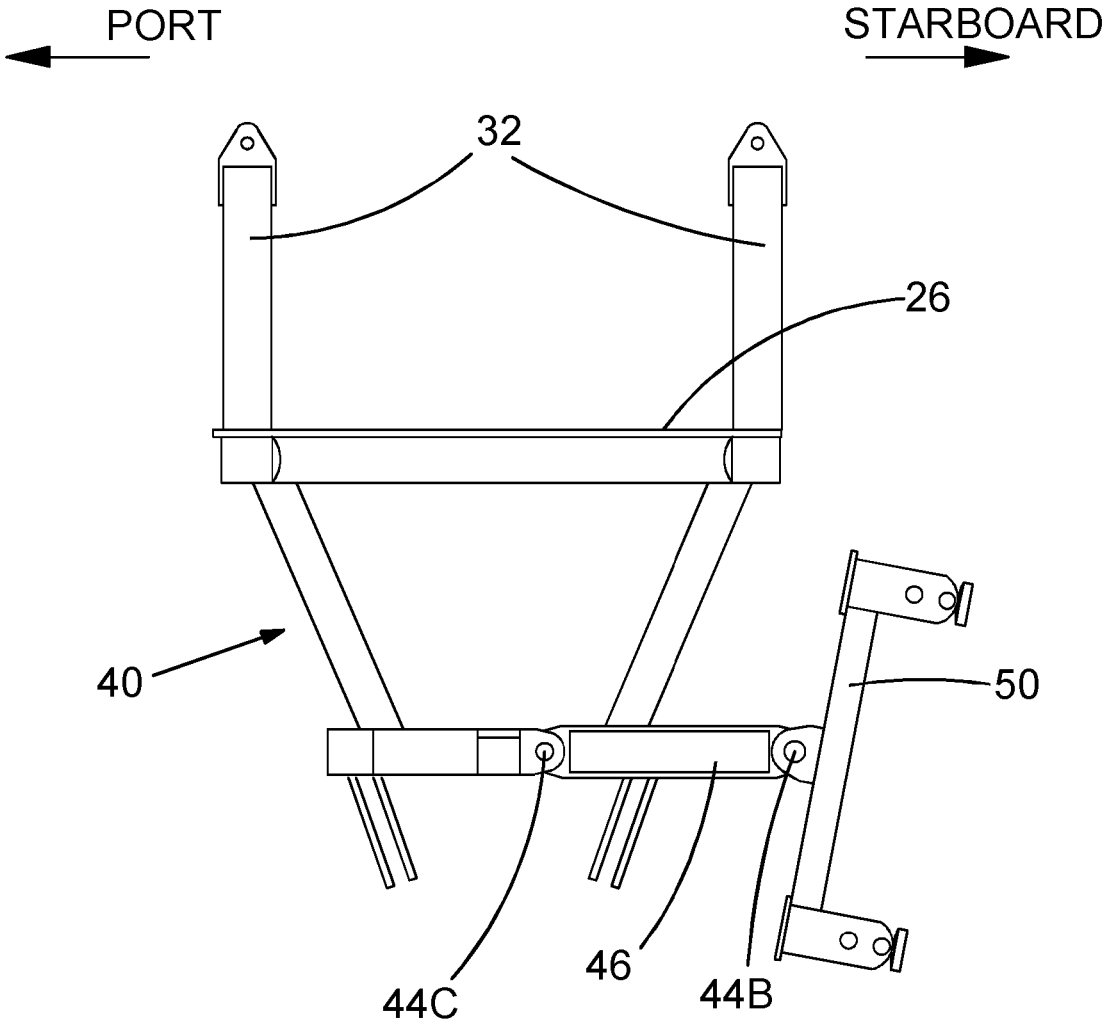
FIG. 10 is a side view of the part shown in FIG. 7 in a third configuration.

When the vessel 14 is on a calm sea, the relative orientations of the platform assembly 10 and the rails 52 are as shown in FIGS. 7 and 8. In FIG. 9, the starboard of the vessel is rolling upwards, and in FIG. 10, the starboard of the vessel is rolling downwards. In these scenarios, the sliding frame 50 hinges relative to the rest of the platform assembly 10 about an axis defined by a first rose joint 44A and a second rose joint 44B. The first and second rose joints 44A, 44B and the hinging axis HA they define can be seen in FIG. 7. The first rose joint 44A connects the support frame 40 beneath the platform 26 to the sliding frame 50, and the second rose joint 44B connects the sliding frame 50 to a first end 68 of the rigid rod 46. The second end 70 of the rigid rod 46 is connected to the support frame 40 by a third rose joint 44C.

Figure 11:
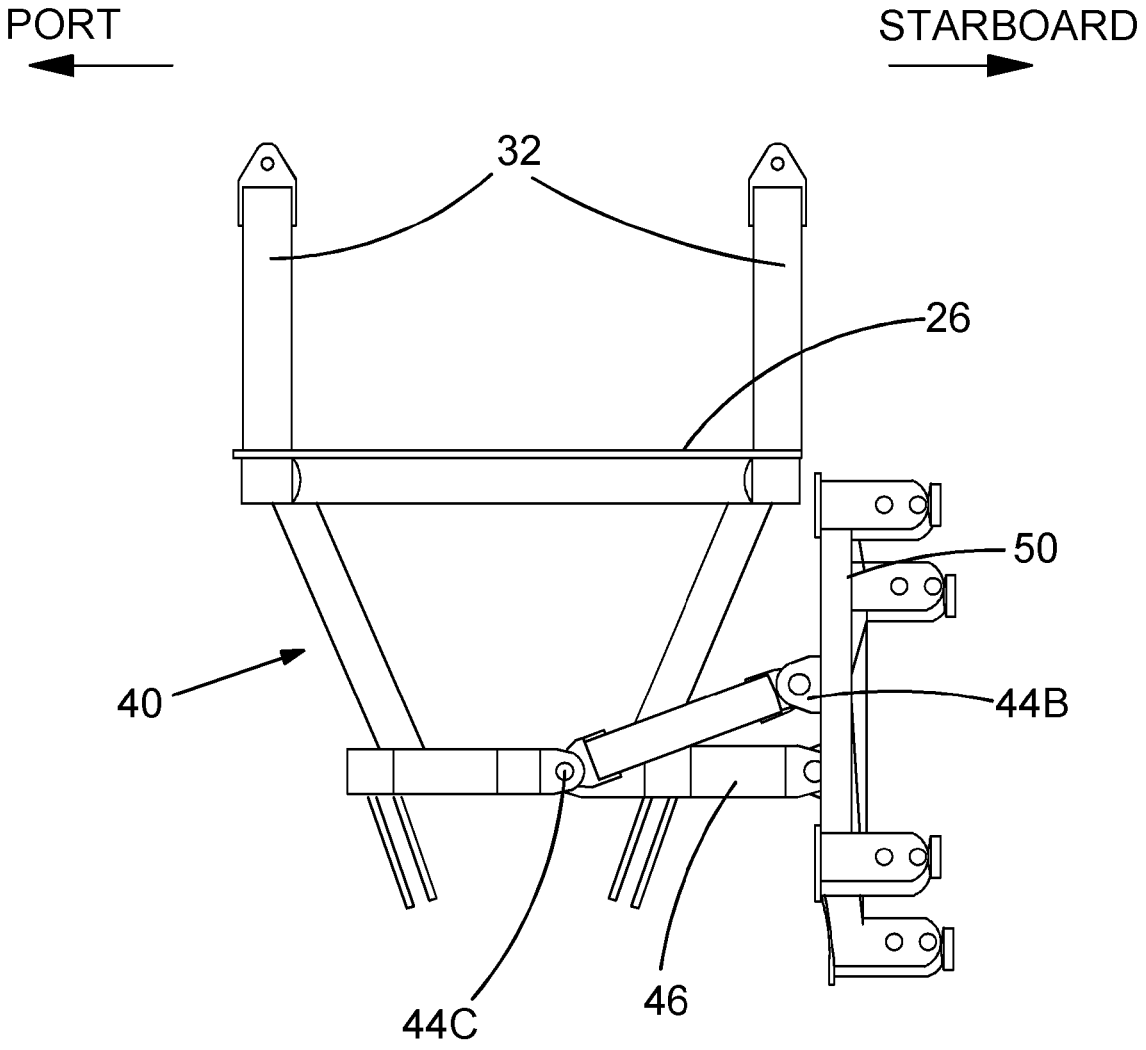
FIG. 11 is a side view of the part shown in FIG. 7 in a fourth configuration.
Figure 12:
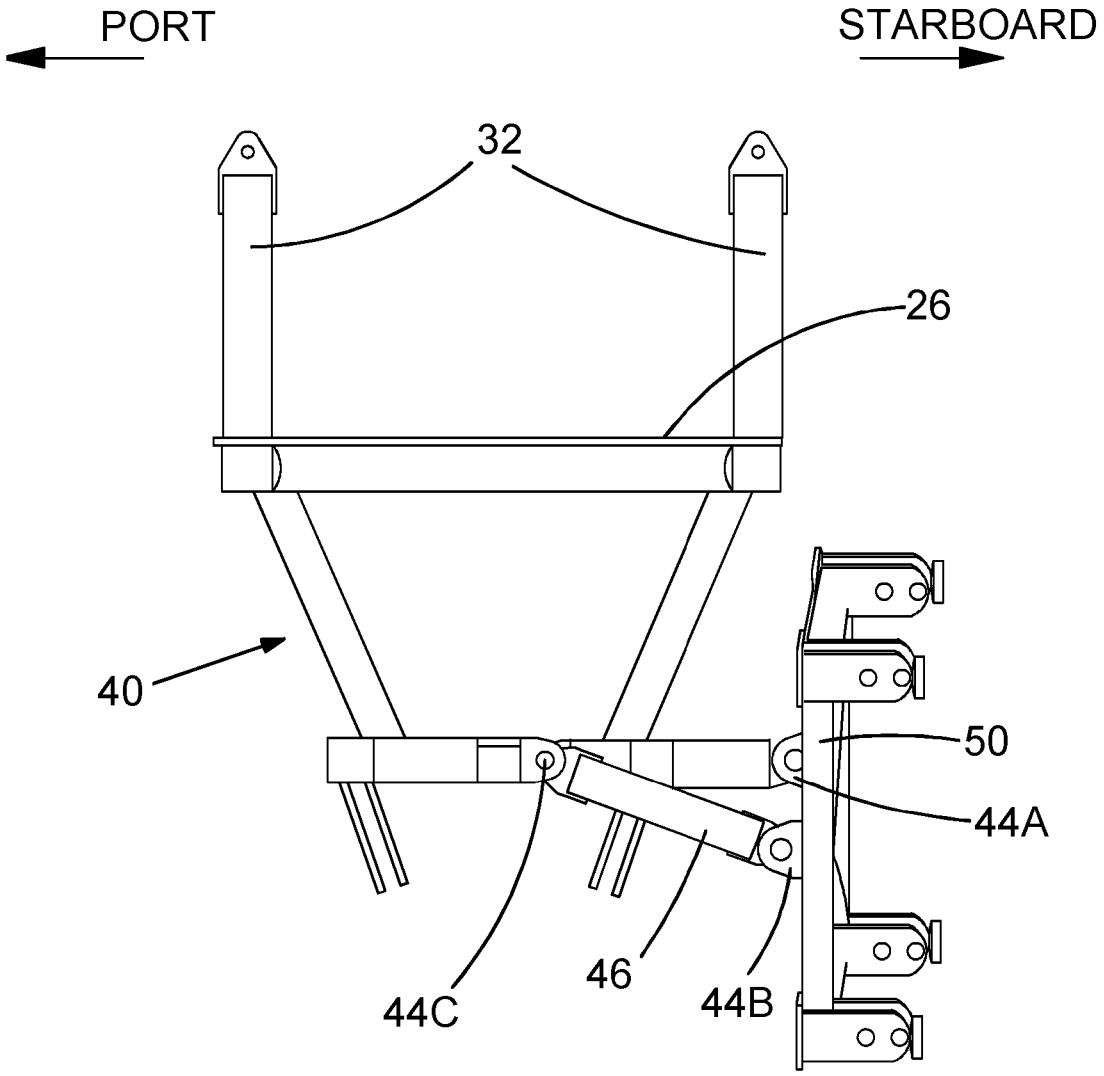
FIG. 12 is a side view of the part shown in FIG. 7 in a fifth configuration.

In FIG. 11, the fore of the vessel 14 is pitching downward. In FIG. 12, the fore of the vessel 14 is pitching upward. In these scenarios, the three rose joints 44 accommodate the rotation of the platform assembly 10 which rotates about an axis which is perpendicular to a longitudinal axis of the vessel and the rigid rod 46 correspondingly hinges relative to the second and third rose joints 44B, 44C to accommodate the resulting rise of one side of the platform 26 relative to the other side. For example, in FIG. 11, the aft side of the platform 26 falls relative to the vessel 14 and the fore side rises relative to the vessel 14. To accommodate this relative motion, the first and second rose joints 44A, 44B move relative to one another.

Figure 14:
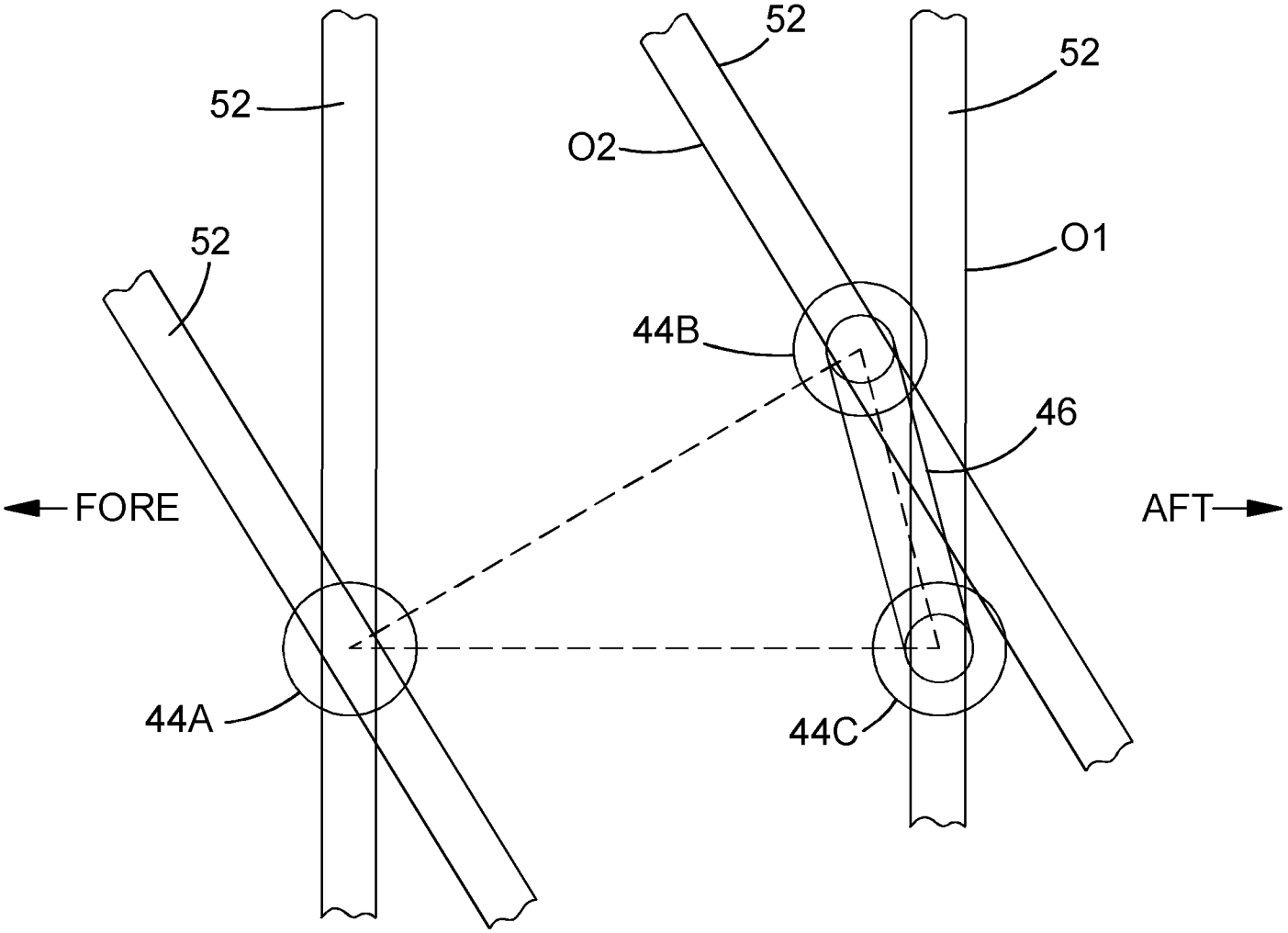
FIG. 14 is a simplified illustration of the operation of connector means according to an embodiment of the invention.

Referring to FIGS. 11 and 14, relative movement between the first and second rose joints 44A, 44B is achieved by providing the rigid rod 46 and third rose joint 44C. The rigid rod 46 hinges relative to the second and third rose joints 44B, 44C and the rose joints 44A, 44B, 44C rotate to enable the first and second joints 44A, 44B to move relative to one another. FIG. 14 shows the relative movement of the rails 52, joints 44A, 44B, and 44C, and rod 46 as the rails 52 rotate relative to the platform 26 from a first orientation O1, wherein the vessel is upright on a calm sea, to a second orientation O2, wherein the aft side of the platform 26 has risen relative to the vessel as in the scenario shown in FIG. 11.

A second sliding frame (not shown) may be installed beneath the rails 52 and the support frame 40 to stabilise the subsea stack 18 when the subsea stack 18 is being launched and recovered through the moon pool 24.

The co-operation between the tensioning means 28 and the connector means 42 will now be described.

It is important to have workers on the working area experience as little acceleration as possible while they are on the platform 26 and while the vessel 14 pitches, rolls, and heaves. Therefore, the platform assembly 10 is fixed relative to the riser 16 to provide as stable a working area as possible. When providing a platform 26 that is fixed to the riser, it is important to maintain an upward tension on the riser 16 to keep the riser 16 in position, and it is desirable to exert as little bending moment as possible on the riser 16 to minimise the likelihood of damaging the riser 16.

The hydraulic cylinders 34 described above balance the tensions in each wire 30 by changing in length in response to changes in tension which arise from movement of the vessel 14 relative to the platform 26. This prevents a net bending moment being applied to the platform 26, and thus the riser 16. In situations such as particularly rough seas, it becomes desirable to attach the platform assembly 10 to the vessel 14 to prevent the riser 16 from coming into contact with edges of the moon pool 24. It is desirable to do this in such a way that the bending moment applied to the platform assembly via the wires 30 remains as close to zero as reasonably practicable. To achieve this, the platform assembly 10 is connected to the rails 52 as described above, and the arrangement of the three rose joints 44A, 44B, 44C and rigid rod 46 allow the platform 26 to pivot relative to the vessel 14 to the extent provided by the dimensions of the joints 44A, 44B, 44C and rod 46. Therefore, a safe working area is provided to workers, the likelihood of damage to the platform 26 or riser 16 by a bending moment is minimised, and the platform 26 is prevented from hitting the sides of the moon pool 24, thereby prevent damage to the hull of the vessel 14.

Referring to FIGS. 16, 17 and 18, a platform assembly of a second embodiment of the present invention is shown. A plurality of first sheaves 77 (in the example shown in FIGS. 16, 17 and 18, three sheaves are shown, but other numbers of sheaves could be used) are mounted to spaced apart locations on the platform 26. A plurality of second sheaves 78 are mounted to the derrick 12. The tensioning means includes a flexible tension applying member in the form of a steel cable 79, which passes around each first sheave 77 and each second sheave 78 in turn so that the sheaves are connected in series so as to apply generally the same tension to each first sheave 77 location on the platform. As the vessel 14 moves relative to the top of the riser 16, the platform 26 can change angle about orthogonal horizontal axes relative to the vessel, and the distance between each first sheave 77 and second sheave 78 will change to compensate for this angular change. The end of the flexible tension applying member 79 can be connected to a winch or ram-rig system (not shown) to allow for translation of the platform 26 along the rails 52.

Referring to FIG. 19, the platform assembly of the second embodiment of the present invention is shown with the platform cut away. The connecting means between the platform 26 and the carriage 50 is similar to the connecting means described in the first embodiment with the addition of a first hydraulic cylinder 80 and a second hydraulic cylinder 81 connected at two different positions between the platform 26 and the carriage 50. The first and second hydraulic cylinders 80, 81 change length when the angle of the platform 26 with respect to the carriage 50 about two orthogonal horizontal axes changes. With the first and second hydraulic cylinders 80,82 in float, the platform 26 is free to change angle with respect to the vessel 14 under the influence of the riser 16. With the first and second cylinders 80,81 in position control the angle between the platform 26 and vessel 14 can be fixed.

FIG. 20 is a schematic view of the platform assembly of the second embodiment of FIG. 16 showing operation of the tensioning means and a typical reeving arrangement to connect the platform 26 tensioning means 28 with a heave compensated ram-rig.

It will be appreciated by persons skilled in the art that the above embodiment has been described by way of example only, and not in any limitative sense, and that various alterations and modifications are possible without departure from the scope of the invention as defined by the appended claims.

The invention claimed is:

1. A platform assembly for providing a work area around a well riser, the assembly comprising:

a platform configured to be attached to the well riser; and a tensioning device for applying a tension force for supporting the platform relative to a vessel and supporting the riser, wherein the tensioning device is adapted to apply a respective tension force at each of a plurality of locations on the platform, and at least one first part of the tensioning device is adapted to change in length in response to angular movement of the vessel relative to the riser;

the platform assembly further comprising connecting device for connecting the platform to the vessel, wherein the platform is restrained against movement parallel to first and second axes, and is able to move parallel to a third axis, wherein said first, second, and third axes are substantially perpendicular to each other;

wherein the platform is restrained from pivoting about said third axis but is able to pivot about said first and second axes; and wherein the platform assembly is slideably moveable relative to the vessel along rails, wherein the rails are configured to rotate relative to the platform assembly.

2. A platform assembly according to claim 1, wherein the tensioning device comprises at least one flexible tension applying member adapted to apply substantially the same tension to said plurality of locations on the platform.

3. A platform assembly according to claim 2, wherein the tensioning device further comprises a plurality of first sheaves adapted to be mounted to the platform and said at least one flexible tension applying member is adapted to apply a tension to said plurality of first sheaves.

4. A platform assembly according to claim 3, wherein said first part of the tensioning device comprises a respective part of said flexible tension applying member extending between at least one of said plurality of first sheaves and the vessel.

5. A platform assembly according to claim 3, wherein the tensioning device further comprises a plurality of second sheaves adapted to be mounted to the vessel and said at least one flexible tension applying member is adapted to apply a tension to said plurality of second sheaves.

6. A platform assembly according to claim 1, wherein the tensioning device comprises a plurality of tension applying members adapted to be interconnected to apply substantially the same tension to said plurality of locations on the platform.

7. A platform assembly according to claim 6, wherein said plurality of tension applying members are flexible.

8. A platform assembly according to claim 7, wherein said plurality of flexible tension applying members are adapted to be connected in series.

9. A platform assembly according to claim 1, wherein said at least one first part of the tensioning device comprises at least one respective hydraulic cylinder.

10. A platform assembly according to claim 9, wherein at least two hydraulic cylinders are in fluid communication with one another.

11. A platform assembly according to claim 10, wherein the at least two hydraulic cylinders are so linked in hydraulic communication as to enable the platform to pivot about first and second axes relative to the vessel, wherein said first and second axes are substantially perpendicular to each other.

12. A platform assembly according to claim 9, further comprising a fluid control device for controlling a fluid volume of said at least one hydraulic cylinder.

13. A platform assembly according to claim 12, further comprising at least one sensor for determining at least one of: (i) an angle between the platform and the vessel; (ii) a fluid volume of said at least one hydraulic cylinder; and (iii) a fluid pressure of said at least one hydraulic cylinder.

14. A platform assembly according to claim 12, wherein the fluid control device is configured to change a fluid volume of said at least one hydraulic cylinder responsive to a determination of at least one sensor.

15. A platform assembly according to claim 9, further comprising at least one fluid flow control valve for controlling a flow of fluid into or out of said at least one hydraulic cylinder.

16. A platform assembly according to claim 15, wherein the at least one fluid flow control valve is configured to be closed for enabling the platform to be kept stationary relative to the vessel.

17. A platform assembly according to claim 1, wherein the tensioning device is adapted to control a height of the platform relative to the vessel in response to movement of the vessel.

18. A platform assembly according to claim 17, wherein the tensioning device comprises at least one respective tensile member connected to each of a plurality of locations on said assembly, wherein vertical motion of said tensile members is synchronised in use.

19. A platform assembly according to claim 1, wherein the connecting device comprises a first joint configured to mount the platform to the vessel, a second joint configured to mount a rigid member to the vessel, and a third joint configured to mount the rigid member to the platform.

20. A platform assembly according to claim 19, wherein at least one of said first joint, second joint, and third joint is a rose joint.

* * * * *